US005531609A

United States Patent [19]

Cheng et al.

[11] Patent Number: 5,531,609

[45] Date of Patent: Jul. 2, 1996

[54] STRUCTURE OF LAMP SOCKET

[76] Inventors: You-Jen Cheng; Tzu-Ling Cheng, both of 2nd Fl., 18-9, Tienmu W. Road, Taipei City, Taiwan

[21] Appl. No.: 270,600

[22] Filed: Jul. 5, 1994

[51] Int. Cl.[6] ..... H01R 4/50

[52] U.S. Cl. ..... 439/340; 439/419

[58] Field of Search ..... 439/306, 339, 439/340, 356, 414, 419, 665; 313/318

[56] References Cited

U.S. PATENT DOCUMENTS

| | | | |
|---|---|---|---|
| 1,710,373 | 4/1929 | Moore | 439/306 |
| 1,738,341 | 12/1929 | Wulle | 439/665 |
| 2,308,016 | 1/1943 | Mihalyi | 439/356 X |
| 2,570,751 | 10/1951 | Benander | 439/419 |
| 5,421,742 | 6/1995 | Huang | 439/419 |

*Primary Examiner*—Khiem Nguyen
*Attorney, Agent, or Firm*—Ladas & Parry

[57] ABSTRACT

A lamp socket of the type having a first contact metal plate and a second contact metal plate fastened to a socket body thereof, and a socket cap fastened to the socket body to hold down an electric wire causing the first and second contact metal plates to make a respective electric contact with either conductor of the electric wire, wherein two toothed locating plates are mounted within two vertical mounting holes on the socket body to mesh with the threaded base of the bulb so that the bulb is prohibited from being pulled out of the socket body in the axial direction without through a rotary motion.

1 Claim, 3 Drawing Sheets

STRUCTURE OF LAMP SOCKET

BACKGROUND OF THE INVENTION

The present invention relates to lamp sockets, and more particularly to a such a lamp socket which easy and inexpensive to manufacture and, which firmly holds down the bulb when the bulb is mounted.

Various decorative strings and Christmas tree light sets are well-known and intensively used in western countries as well as most Asian countries during Christmas holidays. When installed, decorative strings and Christmas tree light sets are controlled to flash or to give different colors of light. In recent days, the requirement for a safety operation on decorative lighting devices has become more and more critical. UL and CSA define strict specifications on these products. The lamp socket for a regular decorative string or Christmas tree light set is generally comprised of an internally threaded plastic socket body having a first contact metal plate and a second contact metal plate mounted on the inside. The socket body has a wire groove on the top end thereof for mounting the electric wire, and two slots through which the top end of either contact metal plate projects. The contact metal plates have each a beveled top edge projecting out of either slot into the wire groove. When the electric wire is placed in the wire groove, a plastic socket cap is fastened to the socket body to hold down the electric wire, causing the beveled top edges of the contact metal plates pierced the insulator of either conductor of the electric wire to make a respective electric contact. The first contact metal plate has a curved bottom end transversely disposed inside the socket body at the top and stopped between two ribs. When the base of the lamp bulb is threaded into the socket body, the tip and ring contacts of the lamp bulb are respectively connected to the conductors of the electric wire through the contact metal plates. This structure of lamp socket is functional however, it has drawbacks. The major drawback of this structure of lamp socket is that the socket body may expand when hot, causing a gap produced between the base of the lamp bulb and the threaded inside wall of the socket body. Therefore, an electric shock may occur when one touches the lamp bulb.

There is known a lamp socket designed to eliminate the aforesaid drawback by fastening a contact metal socket to the socket body of the lamp socket on the inside through a screw joint to hold the bulb. Therefore, the ring contact of the bulb can be electrically connected to the second contact metal plate and the tip contact of the bulb can be extended out of a hole on the contact metal socket and to make an electric contact with the first contact metal plate. The contact metal socket has a serrated outward flange at the bottom engaging the inside wall of the socket body to secure the connection between the socket body and the contact metal socket. This structure of lamp socket eliminates the aforesaid drawback however, its manufacturing cost is high.

SUMMARY OF THE INVENTION

The present invention has been accomplished to eliminate the drawbacks of the aforesaid conventional lamp sockets. According to the present invention, two toothed locating plates are mounted within two vertical mounting holes on the socket body to mesh with the threaded base of the bulb so that the bulb is prohibited from being pulled out of the socket body in the axial direction without through a rotary motion.

BRIEF DESCRIPTION OF THEE DRAWINGS

Figure 2:
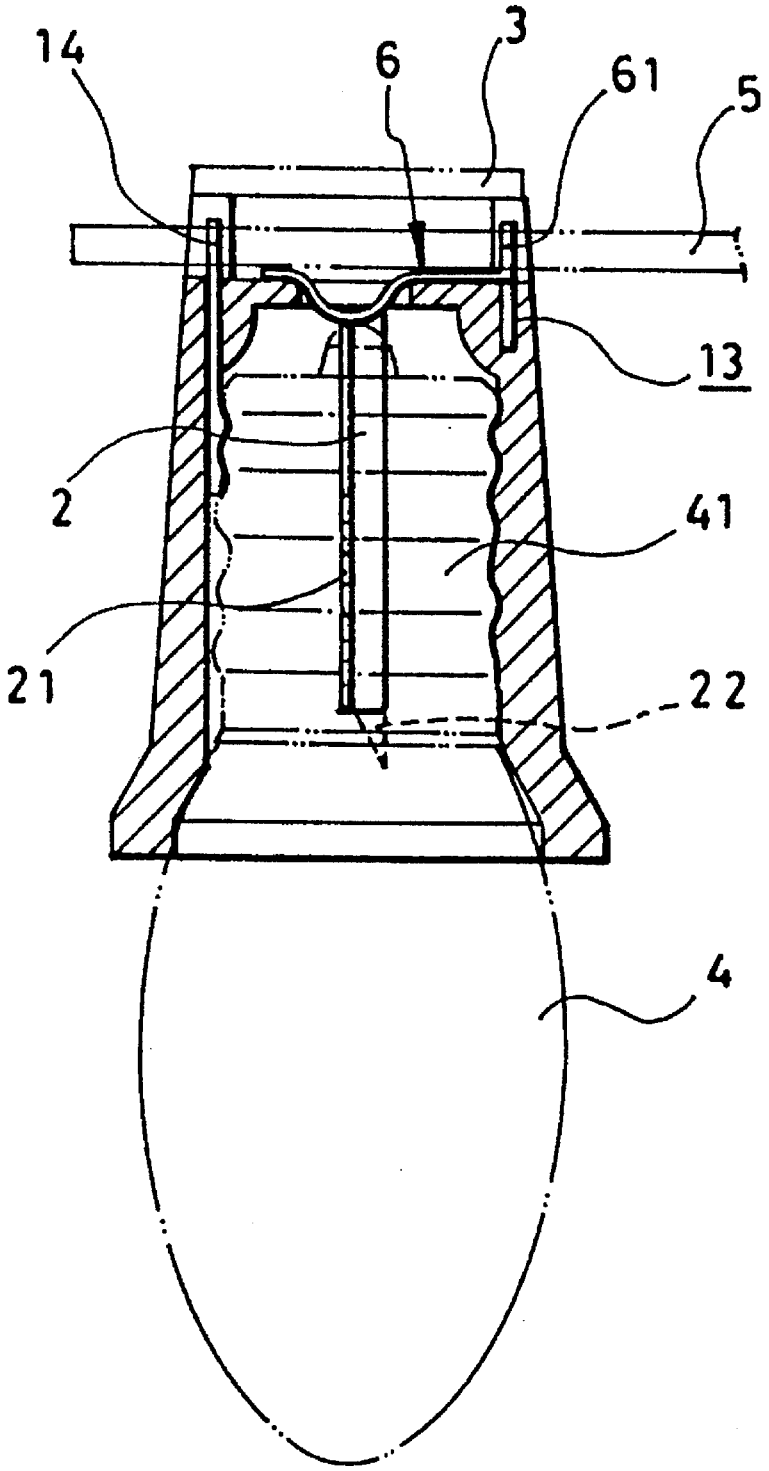
FIG. 2 is a sectional view taken along line A—A of FIG. 1.

Fig.; 3 is a sectional view taken along line B—B of FIG. 2.

DETAILED DESCRIPTION OF THE PREFERRED EMBODIMENT

Figure 1:
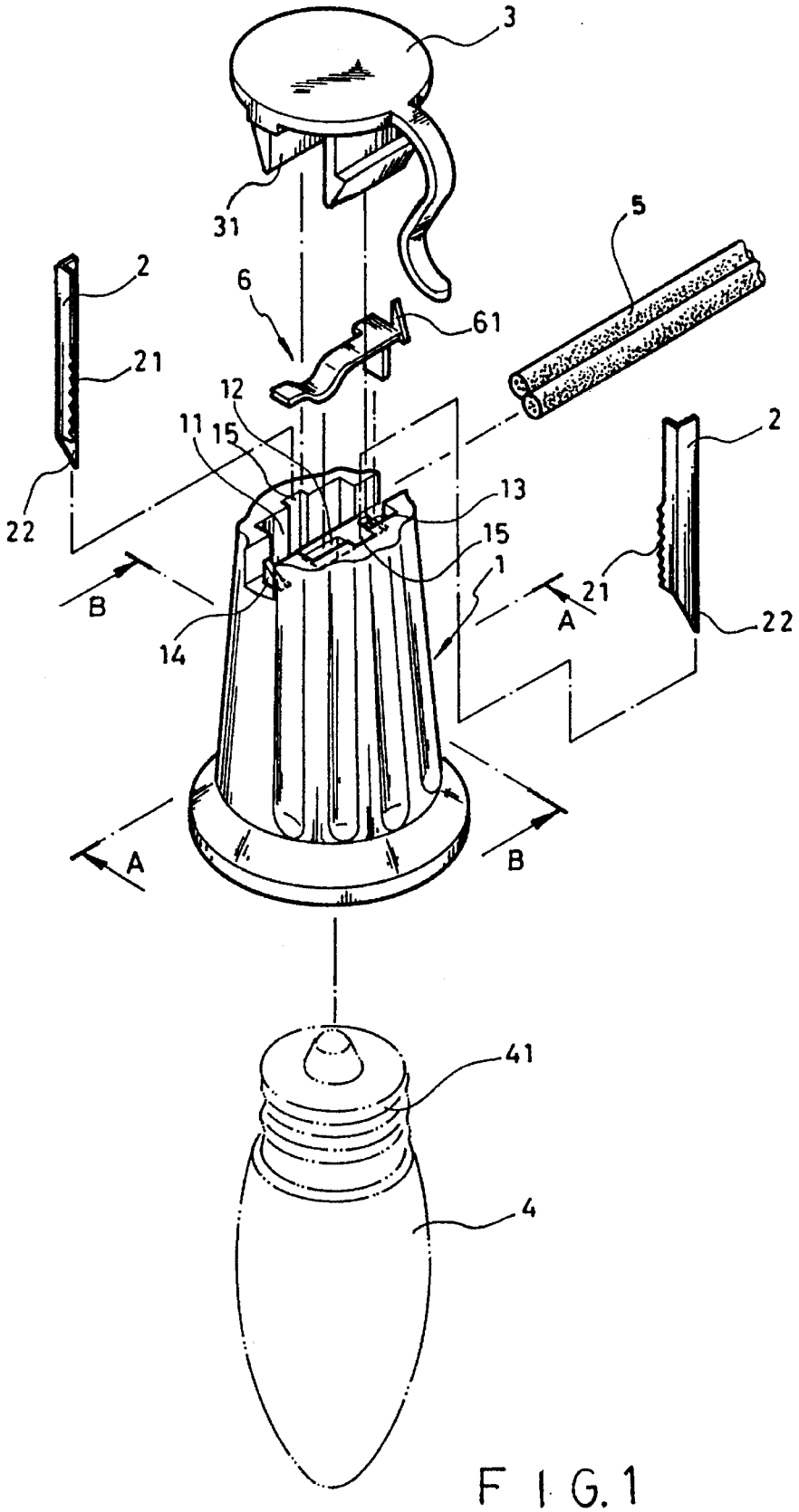
FIG. 1 is an exploded view of a lamp socket according to the present invention.
Figure 3:
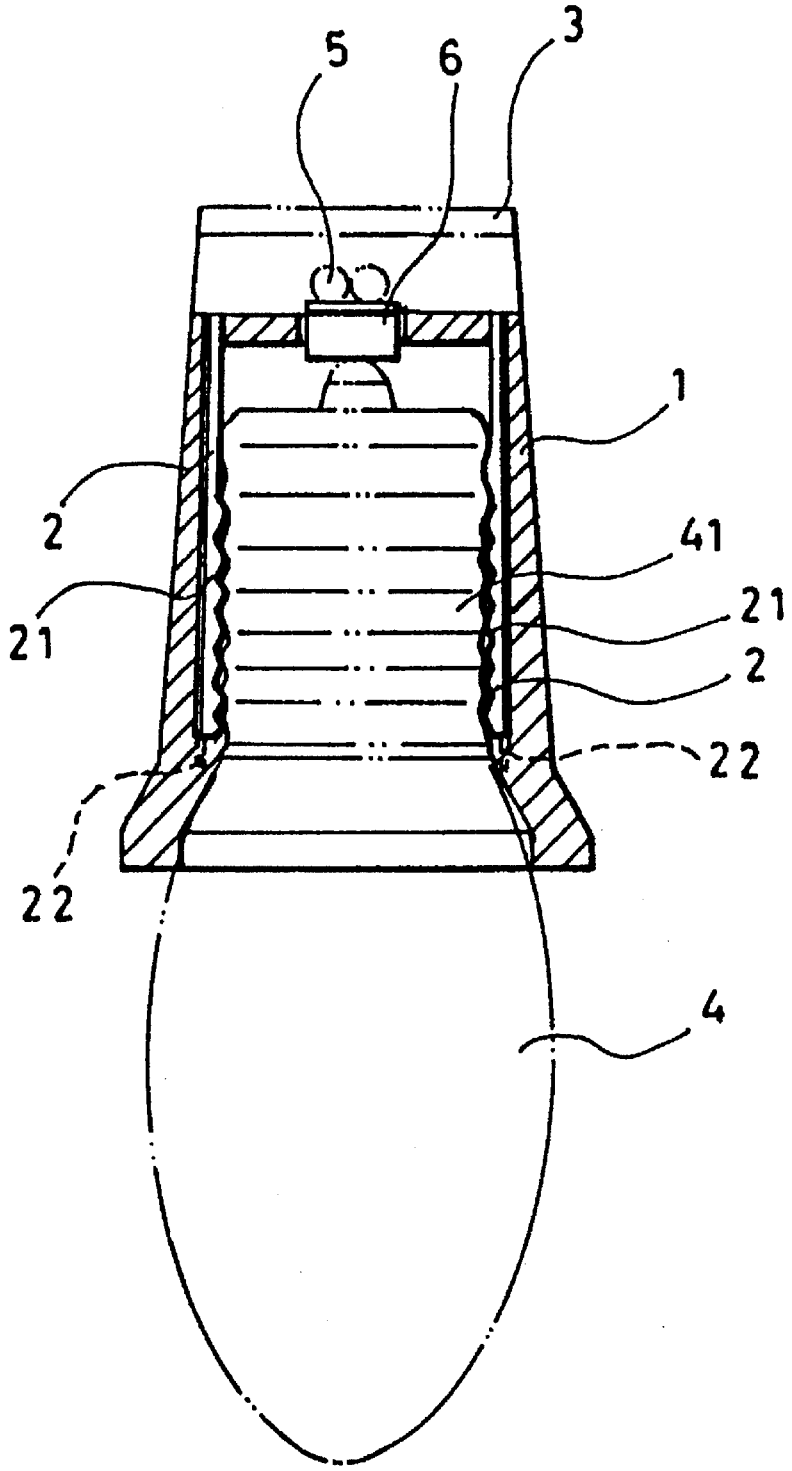

Referring to FIGS. 1, 2, and 3, a lamp socket in accordance with the present invention comprises mainly a socket body 1, two locating plates 2, a socket cap 3, a first contact metal plate 6, and a second contact metal plate 14. The socket body 1 comprises a wire groove 11 on the top end thereof for mounting an electric wire 5, two slots 13 through the wire groove 11 at two opposite sides for passing the first and second contact metal plates 6 and 14 respectively, and a center through hole 12 through the wire groove 11 at the center. The socket cap 3 is fastened to the socket body 1 to hold down the electric wire 5 in the wire groove 11, having two bottom hooks 31 respectively hooked in respective retaining holes (not shown) on the socket body 1. The first and second contact metal plates 6 and 14 are respectively disposed inside the socket body 1, having each a beveled projection 61 extended out of either slot 13 and pierced the insulator of either conductor of the electric wire 5 to make a respective electric contact.

Referring to FIGS. 1 through 3 again, the socket body 1 further comprises two vertical mounting holes 15 bilaterally longitudinally made on the threaded inside wall. Each vertical mounting hole 15 has a bottom end blocked and a top end disposed in communication with the wire groove 11 for mounting either locating plate 2. The locating plates 2 are respectively shaped like an angle bar having one side fitted into either vertical mounting hole 15 and an opposite side 21 toothed. Each locating plate 2 has a beveled bottom end 22 so that it can be conveniently inserted into either vertical mounting hole 15 and engaged into the surface of the blocked bottom end of the respective vertical mounting hole 15. When the base 41 of the bulb 4 is threaded into the socket body 1, the toothed sides 21 of the locating plates 2 are meshed with the threaded the base 41 of the bulb 4 to hold down the bulb 4 in position, and therefore the bulb 4 cannot be pulled out of the socket body 1 axially without through a rotary motion.

What is claimed is:

1. A lamp socket of the type having an internally threaded socket body having a wire groove, a socket cap fastened to said socket body to hold down an electric wire in said wire groove, a first contact metal plate and a second contact metal plate respectively fastened in a respective hole on said socket body and having each a top end connected to either conductor of said electric wire and a bottom end disposed inside said socket body, and a bulb threaded into the inside wall of said socket body and electrically connected to said electric wire through said first and second contact metal plates, the improvement comprising two vertical mounting holes longitudinally bilaterally made on the inside wall of said socket body, each vertical mounting hole having a blocked bottom end and an open top end in communication with said wire groove; and two locating plates respectively inserted into said vertical mounting holes, each locating plate having a beveled bottom end engaged into the blocked bottom end of either vertical mounting hole and a toothed portion vertically disposed at one side and meshed with the threaded base of said bulb to prohibit said bulb from being pulled out of said socket body in the axial direction.

* * * * *